United States Patent [19]

Raasch

[11] Patent Number: 4,541,232

[45] Date of Patent: Sep. 17, 1985

[54] DEVICE FOR DRIVING A FRICTION SPINNING UNIT

[75] Inventor: Hans Raasch, Monchen-Gladbach, Fed. Rep. of Germany

[73] Assignee: W. Schlafhorst & Co., Monchen-Gladbach, Fed. Rep. of Germany

[21] Appl. No.: 609,773

[22] Filed: May 14, 1984

[30] Foreign Application Priority Data

May 13, 1983 [DE] Fed. Rep. of Germany ..... 3317368

[51] Int. Cl.[4] ..... D01H 1/241; D01H 1/20; D01H 1/135

[52] U.S. Cl. ..... 57/104; 57/105; 57/401

[58] Field of Search ..... 57/104, 105, 348, 400, 57/401, 78

[56] References Cited

U.S. PATENT DOCUMENTS 3,142,146 7/1964 Szaloki ..... 57/105
3,548,582 12/1970 Staufert ..... 57/104 X
3,753,344 8/1973 Merck ..... 57/105
4,334,400 6/1982 Fehrer ..... 57/401 X
4,362,008 12/1982 Parker et al. ..... 57/401 X
4,485,617 12/1984 Schmitt et al. ..... 57/104 X

*Primary Examiner*—Donald Watkins
*Attorney, Agent, or Firm*—Herbert L. Lerner; Laurence A. Greenberg; Adam A. Jorgenson

[57] ABSTRACT

A friction spinning machine having a plurality of friction spinning units, each of the spinning units including two rotatable parts forming a spinning wedge, and two whorls each being connected to a respective one of the rotatable parts, includes a device for driving the rotatable parts, the driving device including a common endless belt wound around both of the whorls, a drive roller around which the endless belt is wound for transmitting the belt drive, a tangential belt guided along the length of the friction spinning machine, and a device for engaging and disengaging frictional contact between the tangential belt and the endless belt or belt roller.

14 Claims, 3 Drawing Figures

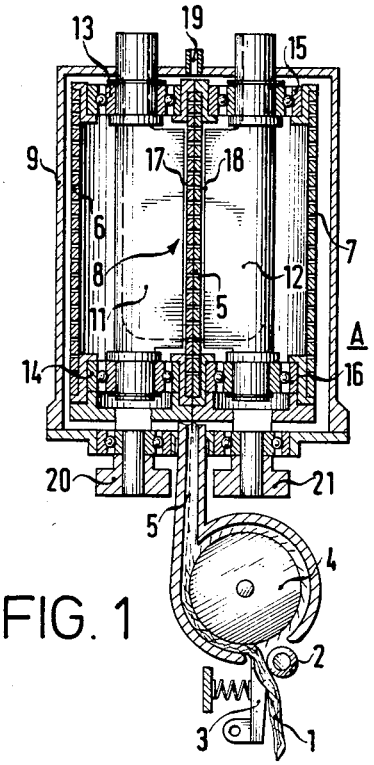
FIG. 1
FIG. 2
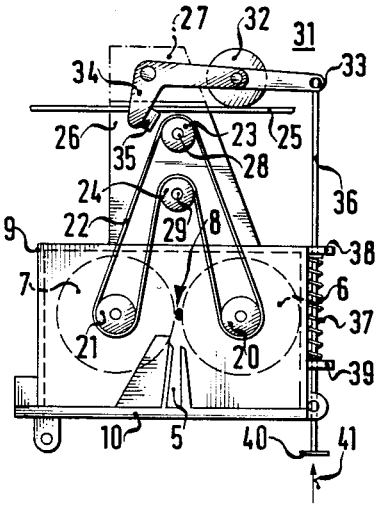
FIG. 3
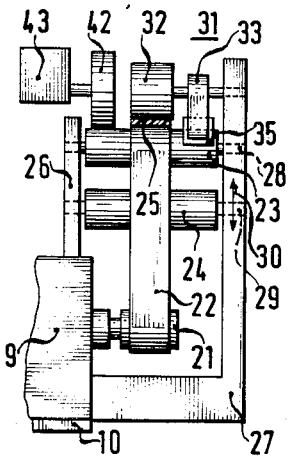

DEVICE FOR DRIVING A FRICTION SPINNING UNIT

The invention relates to a device for driving rotating parts of a friction spinning unit in opposing directions for forming a spinning wedge, in a friction spinning machine having several such friction spinning units.

The rotatable parts may be sieve drums. As an alternative, at least one of the rotatable parts may be a sieve drum, which could be provided with a suction nozzle that affects the spinning wedge by sucking air through the wall of the sieve drum. The other rotatable part may be differently constructed. For example, it could be made in the form of a simple drum.

Experience has shown that a good spinning result is obtained if the synchronization of the rotating parts which form the spinning wedge is guaranteed. Regardless of whether the rotatable parts rotate with the same peripheral velocity, or with peripheral velocities which differ from each other, their synchronization is essential for the spinning result.

It is accordingly an object of the invention to provide a device for driving a friction spinning unit, which overcomes the hereinafore-mentioned disadvantages of the heretofore-known devices of this general type and which guarantees the synchronization of the rotatable parts that form the spinning wedge.

With the foregoing and other objects in view there is provided, in accordance with the invention, a friction spinning machine having a plurality of friction spinning units, each of the spinning units including two rotatable parts forming a spinning wedge, the parts being movable in opposite directions at least at a portion of the surface thereof, and two whorls or wharves or pulleys each being connected to a respective one of the rotatable parts, comprising a device for driving the rotatable parts, the driving device including a common endless belt wound or wrapped around both of the whorls, a drive roller around which the endless belt is wound for transmitting the belt drive, a tangential belt guided along the length of the friction spinning machine, and means for engaging and disengaging frictional contact between the tangential belt and the endless belt or belt roller.

The invention provides a simple, low-noise, easily maintained, self-enclosed drive system for the two rotatable parts. The system uses a tangential belt which is conducted along the length of the friction spinning machine, and which is selectively connected during the start of the spinning operation, or for repairing a thread break, with a special, preferably controllable, drive apparatus.

In accordance with another feature of the invention, the engaging and disengaging means are in the form of a switching device.

In accordance with a further feature of the invention, the tangential belt has a first surface facing the belt roller and a second surface facing away from the belt roller, and the switching device includes a pressure roller contacting the second surface of the tangential belt.

In accordance with an added feature of the invention, the switching device includes a swivelable lever on which the pressure roller is rotatably supported, and an operating element connected to the lever, the lever being movable manually and/or automatically by the operating element.

In accordance with an additional feature of the invention, the switching device includes a spring-loaded tie rod connected to the operating element for pressing the pressure roller against the tangential belt.

In accordance with again another feature of the invention, there is provided a brake functionally connected to the switching device for acting on the belt roller.

In accordance with again a further feature of the invention, the lever is an angle lever having a first arm connected to the pressure roller and a second arm, and including a brake pad disposed on the second arm for acting on the belt roller In accordance with again an added feature of the invention, there is provided an additional driving apparatus being frictionally engageable and disengageable for contacting the belt roller.

In accordance with again an additional feature of the invention, the additional driving apparatus is a friction wheel for contacting the belt roller.

In accordance with yet another feature of the invention, the additional driving apparatus is part of an automatic device for starting a spinning operation and driving the endless belt at given stages of the spinning operation, i.e. when starting the spinning operation or during operation after a thread break has occured In accordance with yet a further feature of the invention, there is provided another belt roller around which the endless belt is wound for increasing the angle or portion of the periphery of the whorls through which the endless belt is wound.

In accordance with a concomitant feature of the invention, the other belt roller adds tension to the endless belt.

Other features which are considered to be characteristic for the invention are set forth in the appended claims.

Although the invention is illustrated and described herein as embodied in a device for driving a friction spinning unit, it is nevertheless not intended to be limited to the datils shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a partially cross-sectional front-elevational view of part of a friction spinning unit in which the housing is open;

FIG. 2 is a side-elevational view of the friction spinning unit, showing the driver elements in particular; and FIG. 3 is a fragmentary side-elevational view of the representation according to FIG. 2.

Referring now to the figures of the drawing in detail and first particularly to FIG. 1 thereof, there is seen part of a friction spinning unit which is designated as a whole by the letter A, and is one of several individual friction spinning units which are combined to form a friction spinning machine. A sliver 1 is conducted through a feed or drawing-in roller 2 and a clamping plate 3 to a dissolving or loosening roller 4 which is provided with needles or a set of saw teeth. This dissolving roller 4 rotates at a high peripheral velocity, and dissolves the sliver 1 to its individual fibers. The dissolved fibers are conducted through a fiber channel 5 into a spinning wedge 8 which is formed by two rotating parts 6, 7.

The two rotating parts 6, 7 are constructed in the form of sieve drums. The sieve drums 6, 7 are enclosed by a housing 9, which is closed by a cover 10, as seen in FIG. 2. The fiber channel 5 passes through the cover 10.

FIG. 1 shows that the sieve drum 6 is held and supported by a suction device 11 in the following manner:

The suction device 11 is tubular, extends through the housing 9, and is in a fixed connection with the housing 9. Directly behind the location at which the suction device 11 passes through the housing, is a roller bearing 13 which supports the sieve drum 6. The suction device has a similar roller bearing 14 at the other end thereof which also supports the sieve drum 6. The side of the suction device 11 ends at a suction nozzle 17 which is directed toward the spinning wedge 8, and has almost the same length as the sieve drum 6.

The other sieve drum 7 is also supported in the housing 9 in a similar manner. A second suction device 12 is provided, which is also tubular, extends through the housing 9, and is in a fixed connection with the housing 9. Directly behind the location at which the suction device 12 passes through the housing, it is also provided with a roller bearing 15 that supports the sieve drum 7. The other end of the suction device 12 is also provided with a similar roller bearing 16, which also supports the sieve drum 7.

The side of the suction device 12 also ends at a suction nozzle 18 which is almost as long as the sieve drum 7. The suction nozzle 18 is also directed toward the spinning wedge 8.

Both of the suction devices 11, 12 are supplied with suction air during the spinning operation. The spun thread is pulled along and out of the spinning wedge 8 through a withdrawal or outlet capillary tube 19. This is carried out by a special thread withdrawal device, which is not further explained herein. The withdrawn thread is wound up on a take-up bobbin. The mechanism required for this operation is also not illustrated herein.

FIG. 1 and FIG. 2 show that the sieve drum 6 is provided at the end thereof with a whorl or wharve 20, and the sieve drum 7 is provided with a whorl or pulley 21. A common endless belt 22 wraps or winds around both whorls. The endless belt 22 also wraps around a roller 23 which transmits the belt drive, as well as an additional roller 24. A tangential belt 25, which is conducted along the length of the friction spinning machine, is in frictional contact with the endless belt 22 which wraps around the roller 23, and can be engaged and disengaged.

FIG. 3 illustrates that the rollers are supported in a frame 26, 27. while the axis 28 of the roller 23 is immovably positioned in the frame 26, 27, the axis 29 of the roller 24 can be moved up and down in the frame 26, 27 in the direction of the double arrow in FIG. 3, and be secured in a given position. The sliding capability of the roller facilitates the installation of the belt 22, and permits the later re-tensioning of the belt.

FIGS. 2 and 3 show also that a switching mechanism 31 is provided for engaging and disengaging the friction contact between the tangential belt 25 and the endless belt 22 which wraps around roller 23. The switching mechanism 31 is provided with a pressure roller 32 which contacts the back or rear side of the tangential belt 25. The pressure roller 32 is rotatably supported on a lever 33 which articulates about the frame 27. The lever 33 is in the form of an angular lever. The lever 33 has a second lever arm 34 which carries a brake pad 35 that acts on the roller 23.

The lever 33 can be shifted upward and downward by an operating element 36. FIG. 2 shows that this operating element 36 is made in the form of a pull rod or tie rod which is loaded by a return spring 37, so that it always pulls the lever 33 downward. For this purpose, one side of the return spring 37 bears against a projection 38 of the housing 9, and the other side bears against an adjusting collar 39. A plate 40 is provided at the end of the operating element 36. If a force acts on the plate 40 in the direction of the arrow 41, the operating element 36 moves upward against the force of the return spring 37, lifts the lever 33, and disengages the pressure roller 32 from contact with the tangential belt 25. The tangential belt 25 is guided, so that it moves upward and loses contact with the endless belt 22. If the lever 33 is even lifted up somewhat more, the brake pad 35 contacts the surface of the roller 23, and the sieve drum 6, 7 can therefore be stopped almost instantaneously.

FIG. 3 shows that the roller 23 has a frictional contact which can be engaged or disengaged with an additional drive apparatus 42. This additional drive is in the form of a friction wheel which can contact the belt roller 23, and is part of an automatic device 43 for starting the spinning operation. The device 43 takes over the drive of the endless belt 22, during the start of the spinning operation, or during the operation after a thread-break has occured. Further details of device 43 for starting the spinning operation or for joining the thread, are not described herein. For example, the device may be a movable thread-joining device, which only works in conjunction with the spinning unit A, if this unit generates a command for requiring the thread joining device. Before the friction wheel 42 makes contact with the belt roller 23, the brake pad 35 is lifted from the roller 23 by slightly lowering the lever 33.

The invention is not limited to the illustrated and described embodiment which was used as an example.

The foregoing is a description corresponding in substance to German Application No. P 33 17 368.0, filed May 13, 1983, the International priority of which is being claimed for the instant application, and which is hereby made part of this application. Any discrepancies between the foregoing specification and the aforementioned corresponding German application are to be resolved in favor of the latter.

I claim:

1. In a friction spinning machine having a plurality of friction spinning units, each of the spinning units including two rotatable parts forming a spinning wedge, and two whorls each being connected to a respective one of the rotatable parts, the improvement comprising a device for driving the rotatable parts, said driving device including a common endless belt wound around both of the whorls, a drive roller around which said endless belt is wound for transmitting the belt drive, a tangential belt guided along the length of the friction spinning machine, and means for engaging and disengaging frictional contact between said tangential belt and said endless belt.

2. In a friction spinning machine having a plurality of friction spinning units, each of the spinning units including two rotatable parts forming a spinning wedge, and two whorls each being connected to a respective one of the rotatable parts, the improvement comprising a device for driving the rotatable parts, said driving device including a common endless belt wound around both of the whorls, a drive roller around which said endless belt is wound for transmitting the belt drive, a tangential belt guided along the length of the friction spinning machine, and means for engaging and disengaging frictional contact between said tangential belt and said belt roller.

3. Device according to claim 1, wherein said engaging and disengaging means are in the form of a switching device.

4. Device according to claim 2, wherein said tangential belt has a first surface facing said belt roller and a second surface facing away from said belt roller, and said switching device includes a pressure roller contacting said second surface of said tangential belt.

5. Device according to claim 4, wherein said switching device includes a swivelable lever on which said pressure roller is rotatably supported, and an operating element connected to said lever, said lever being movable manually and by said operating element.

6. Device according to claim 5, wherein said switching device includes a spring-loaded tie rod connected to said operating element for pressing said pressure roller against said tangential belt.

7. Device according to claim 3, including a brake functionally connected to said switching device for acting on said belt roller.

8. Device according to claim 4, including a brake functionally connected to said switching device for acting on said belt roller.

9. Device according to claim 5, wherein said lever is an angle lever having a first arm connected to said pressure roller and a second arm, and including a brake pad disposed on said second arm for acting on said belt roller.

10. Device according to claim 1, including an additional driving apparatus being frictionally engageable and disengageable with said belt roller.

11. Device according to claim 10, wherein said additional driving apparatus is a friction wheel for contacting said belt roller.

12. Device according to claim 10, wherein said additional driving apparatus is part of an automatic device for starting a spinning operation and driving said endless belt at given stages of the spinning operation.

13. Device according to claim 1, including another belt roller around which said endless belt is wound for increasing the angle of the whorls through which said endless belt is wound.

14. Device according to claim 13, wherein said other belt roller adds tension to said endless belt.

* * * * *